United States Patent [19]

Arai et al.

[11] Patent Number: 4,882,310

[45] Date of Patent: Nov. 21, 1989

[54] HEAT-SENSITIVE RECORDING MATERIAL WITH HEAT-SENSITIVE COLOR DEVELOPING LAYER CONTAINING PRISMATIC CALCIUM CARBONATE

[75] Inventors: Naoto Arai, Ikeda; Masaharu Nojima, Amagasaki; Ritsuo Mandoh, Sakai, all of Japan

[73] Assignee: Kanzaki Paper Manufacturing Co., Ltd., Tokyo, Japan

[21] Appl. No.: 253,862

[22] Filed: Oct. 5, 1988

[30] Foreign Application Priority Data

Oct. 8, 1987 [JP] Japan ..... 62-255097

[51] Int. Cl.[4] ..... B41M 5/18

[52] U.S. Cl. ..... 503/207; 427/150; 428/330; 428/913; 503/200

[58] Field of Search ..... 427/150–152; 428/330, 913, 914; 503/200, 207, 216, 225, 226

[56] References Cited

FOREIGN PATENT DOCUMENTS

| | | | |
|---|---|---|---|
| 128349 | 10/1979 | Japan | 503/207 |
| 155095 | 9/1984 | Japan | 503/207 |
| 2145074 | 3/1985 | United Kingdom | 503/207 |

*Primary Examiner*—Ellis P. Robinson
*Assistant Examiner*—P. R. Schwartz
*Attorney, Agent, or Firm*—Wenderoth, Lind & Ponack

[57] ABSTRACT

An improved heat-sensitive recording material having a substrate and a heat-sensitive recording layer formed thereon which contains a colorless or light-colored basic dye and a color developer to color said basic dye upon contact by heating, said heat-sensitive recording layer being formed by applying a coating dispersion containing prismatic calcium carbonate comprising single particles each having such a particle size that the average length is 1 to 6 μm and the average breadth is 0.1 to 0.6 μm. The heat-sensitive recording material does not generate any foreign matter to contaminate the recording head and it does not cause reduction in the whiteness of the recording layer with the lapse of time.

5 Claims, No Drawings

HEAT-SENSITIVE RECORDING MATERIAL WITH HEAT-SENSITIVE COLOR DEVELOPING LAYER CONTAINING PRISMATIC CALCIUM CARBONATE

FIELD OF THE INVENTION

The present invention relates to an improved heat-sensitive recording material. More particularly, it concerns a highly heat-sensitive recording material which does not generate any foreign matters to contaminate the recording head and which does not cause reduction in its whiteness even upon long time storage.

BACKGROUND OF THE INVENTION

There is well known a heat-sensitive recording material which is so designed as to produce a record image by the aid of a color reaction that takes place between a colorless or light-colored basic dye and an organic or inorganic color developer when the two substances are brought into contact with each other by heat. A heat-sensitive recording material of this type is comparatively inexpensive and suitable for use on a compact recording machine, which is relatively easy in its maintenance. And it is used as a recording medium in facsimile system or various computer systems or in other systems. For said recording material, it is often required to have more improved resistances to oils or plasticizers upon its application area. To meet such requirements, there have been developed relevant basic dyes and color developers. However, many of such color developers, though they exhibit a good chromogenic performance, cannot be directly applied to a substrate for a heat-sensitive recording material as they are, because of their pronounced tendency of generating foreign matters to contaminate the recording head. In order to solve this problem, there has been proposed to use such color developer in combination with a proper pigment. This proposal is effective in solving the above problem. However, under this proposal, there will often occur another problem that the whiteness of the recording layer of a heat-sensitive recording material is remarkably reduced. For example, in the case where a highly oil-absorbing pigment represented by an anhydrous silica fine powder is used, the resulting heat-sensitive recording material will be such that does not cause the problem of contaminating the recording head with foreign matters but does a remarkable reduction in the whiteness of the recording layer. And in the case where an ordinary precipitated calcium carbonate is used as the pigment, occurrence of the reduction in the whiteness of the resulting recording layer is effectively prevented but the resulting recording material will be such that is apt to generate foreign matters to contaminate the recording head when it is used as the recording medium in facsimile system or the printer used in computer system.

Under these circumstances, there is a demand for provision of an improved heat-sensitive recording material which does not cause any foreign matter to contaminate the recording head and which is not deteriorated with the original whiteness even upon storage for a long period of time.

SUMMARY OF THE INVENTION

The object of the present invention is to provide an improved heat-sensitive recording material which is free from the foregoing problems which are found on the known heat-sensitive recording material and capable of satisfying various kinds of requirements in a heat-sensitive recording material.

That is, the main object of the present invention is to provide an improved heat-sensitive recording material which does not generate any foreign matters to contaminate the recording head of facsimile system or of the printer used in computer system.

Another object of the present invention is to provide an improved heat-sensitive recording material which does not cause reduction in its whiteness even upon long time storage.

The present inventors have made extensive studies in order to solve the foregoing problems which are found on the known heat-sensitive recording material and in order to attain the above objects while focusing on the pigment to be used in combination with the color developer.

As a result, it was found that when a selected prismatic calcium carbonate having a specific particle size is used in combination with a proper color developer in the formation of the heat-sensitive color developing layer, there is afforded a desirable heat-sensitive recording material having a high recording sensitivity which does not generate any foreign matter to contaminate the recording head of facsimile system or printer used in computer system and does not cause reduction in its whiteness even upon long time storage. It was also found that said desirable heat-sensitive recording material is also afforded even when such a color developer that becomes to have a high viscosity when melted and is apt to generate foreign matters to contaminate the recording head is used in combination with said prismatic calcium carbonate.

The present invention has been accomplished based on the above findings.

The present invention resides in an improved heat-sensitive recording material comprising a substrate and a heat-sensitive recording layer formed thereon which contains a colorless or light-colored basic dye and a color developer to color said basic dye upon contact by heating, characterized in that the heat-sensitive recording layer is formed by applying a coating dispersion containing prismatic calcium carbonate comprising single particles each having such a particle size that the average length is in the range of from 1 to 6 μm and the average breadth is in the range of from 0.1 to 0.6 μm.

DETAILED DESCRIPTION OF THE INVENTION

As described above, the heat-sensitive recording material according to the present invention is characterized in that the heat-sensitive recording layer contains prismatic calcium carbonate of specific particle size as mentioned above. For the prismatic calcium carbonate to be contained in the heat-sensitive recording layer in the state of being present in the form of single particles, when said single particles are of more than 6 μm for the average length and more than 0.6 μm for the average breadth, the resulting recording layer becomes to have a roughened surface which results in forming such a record image that is poor in record density. And when they are of less than 1 μm for the average length and less than 0.1 μm for the average breadth, the resulting recording layer becomes to have an extremely tight surface with no clearance which results in making the heat-sensitive recording material to generate foreign matters to contaminate the recording head. The form for the prismatic calcium carbonate upon use in the formation of the recording layer of the heat-sensitive recording material according to the present invention is necessary to be in such a state that single particles thereof are being individually dispersed, that is, in a state of slurry.

For this situation, in the case where it is in the form of intertwined aggregate as described in Japanese Patent Laid-open Sho. No. 59(1984)-232916, it is difficult to stably obtain a desirable heat-sensitive recording material which does not generate any foreign matter to contaminate the recording head.

The prismatic calcium carbonate that can be used in the present invention may be either aragonite such as described in Japanese Patent Publication No. 51852/1980 or calcite. However, calcite, which has a Mohs hardness of 3, is rather soft than aragonite, which has a Mohs hardness of 3.5 to 4. In view of this and in consideration of the abrasive action on the recording head, calcite is more desirable.

As mentioned above, the heat-sensitive recording material of the present invention has a heat-sensitive recording layer which is formed by the application of a coating dispersion containing prismatic calcium carbonate slurry, preferably prismatic calcite calcium carbonate slurry, having a specific particle size. The calcium carbonate slurry may be produced according to the process described in, for example, Japanese Patent Laid-open No. 207715/1987. This process starts with the liquid-vapor chemical reaction between carbon dioxide gas and calcium hydroxide solution which forms a calcium carbonate slurry. Then, the slurry is mechanically stirred until it reaches a Brookfield viscosity of 1000 cP or more at 60 rpm, and the stirring is continued for ageing and homogenizing. In this way, there is obtained a slurry of calcite prismatic calcium carbonate. The length and breadth of particles can be properly controlled by adjusting the conditions for carbonization and ageing. The thus obtained slurry of calcite prismatic calcium carbonate may be used for the efficient production of calcite prismatic calcium carbonate having a uniform particle diameter, by mixing the slurry with calcium hydroxide at a mixing ratio of 1 mol of calcium carbonate and 0.5 to 5 mol of calcium hydroxide and introducing carbon dioxide gas into the slurry mixture. As for the aragonite prismatic calcium carbonate, it may be prepared, for example, in accordance with the method disclosed in the aforesaid Japanese Patent Publication No. 51852/1980.

In the case of the heat-sensitive recording material of the present invention, the above-mentioned prismatic calcium carbonate is contained in the heat-sensitive recording layer. It is desired to incorporate said prismatic calcium carbonate into an intermediate layer (undercoat layer) under the color developing layer in the case where said undercoat layer is disposed or into a protective layer on the recording layer in the case where said protective layer is disposed.

The amount of prismatic calcium carbonate in the heat-sensitive recording layer should be 5 to 60 wt% of the total amount of solids. The amount of prismatic calcium carbonate in the intermediate layer or protective layer should be 5 to 90 wt% of the total amount of solids. With less than 5 wt%, it does not provide a practical effect. With more than 60 wt% in the heat-sensitive recording layer, the recording sensitivity will be decreased. With more than 90 wt% in the protective layer, it adversely affects the surface strength and barrier properties.

As mentioned above, the prismatic calcium carbonate having a specific particle size brings about, unlike other pigments, a marked effect of preventing the recording head from contaminating with foreign matters while retaining the whiteness of the recording layer. The reason for this is not yet elucidated completely. However, it is thought that the particles of preismatic calcium carbonate disposed one over another in the color developing layer (or intermediate layer or protective layer) form pores adequate for preventing the recording head from contaminating with foreign matters owing to the unique shape of the particles, and that the foregoing prismatic calcium carbonate has an inherent effect of keeping the whiteness of white paper.

The heat-sensitive recording layer in the heat-sensitive recording material of the present invention contains a known colorless or light-colored basic dye whose examples are enumerated below.

Triarylmethane dyes such as 3,3-bis( p-dimethylaminophenyl)-6-dimethylaminophthalide, 3,3-bis(p-dimethylaminophenyl)phthalide, 3-(p-dimethylaminophenyl)3-(1,2-dimethylindol-3-yl)phthalide, 3-(p dimethylaminophenyl)-3-(2-methylindol-3-yl)phthalide, 3,3-0 bis(l,2-dimethylindol-3-yl)-5-dimethyl-aminophthalide, 3,3-bis(l,2-diemthylindol-3-yl)-6-diemthylaminophthalide, 3,3-bis(9-ethylcarbazol-3-yl)-6-dimethylaminophthalide, 3,3-bis(2-phenylindol-3-yl)-6-dimethylaminophthalide, and 3-p-dimethylaminophenyl-3-(l-methylpyrrol-3-yl)-6dimethylaminophthalide; diphenylmethane dyes such as 4,4'-bis-dimethylaminobenz-hydrylbenzylethyer, N-halophenyl-leucoauramine, N-2,4,5-trichlorophenyl-leucoauramine; thiazine dyes such as benzoyl-leucomethyleneblue and p-nitrobenzoyl-leucomethyleneblue; spiro dyes such as 3-methyl-spiro-dinaphthopyran, 3-ethyl-spiro-dinaphthopyran, 3-phenyl-spiro-dinaphthopyran, 3-benzyl-spiro-dinaphthopyran, 3-methyl-naphtho-(6'-methoxybenzo)spiropyran, and 3-propyl-spiro-dibenzopyran; lactam dyes such as rhodamine-B anilino-lactam, rhodamine (p-nitroanilino)lactam, and rhodmine-(o-chloroanilino)lactam; and fluoran dyes such as 3-dimethyl-amino-7-methoxyfluoran, 3-diethylamino-6-methoxyfluoran, 3-diethylamino-7methoxyfluoran, 3-diethylamino-7-chlorofluoran, 3-diethylamino-6-methyl-7-chlorofluoran, 3-diethylamino-6, 7-dimethylfluoran, 3-(N-ethyl-p-toluidino)-7methylfluoran, 3-diethylamino-7-N-acetyl-N-methylaminofluoran, 3-diethylamino-7-N-methylaminofluoran, 3-diethylamino-7-dibenzylaminofluoran, 3-diethylamino-7-N methyl-N-benzylaminofluoran, 3-diethylamino-7-N-chloroethyl -N-methylaminofluoran, 3-diethylamino-7-N-diethylaminofluoran, 3-(N-ethyl-p-toluidino)-6-methyl-7-phenylaminofluoran, 3-(N-ethyl-p-toluidino)-6-methyl-7-(p-toluidino)fluoran, 3-diethylamino-6-methyl-7phnylaminofluoran, 3-diethylamino-7-(2-carbomethoxyphenylamino)fluoran, 3-(N-cyclohexyl-N-methylamino)-6-methyl-7-phenylaminofluoran, 3-pyrrolidino-6-methyl-7phenylaminofluoran, 3-pyperidino-6-methyl-7phenylaminofluoran, 3-diethylamino-6-methyl-7- 0 xylidinofluoran, 3-diethylamino-7-(o-chlorophenylamino)fluoran, 3-dibutylamino-7-(o-chlorophenylamino)fluoran, 3-pyrrolidino-6-methyl-7-p- butylphenyl-aminofluoran, 3-diethylamino-7-(o- 0 fluorophenylamino)-fluoran, 3-dibutylamino-7-(o-fluorophenylamino)fluoran, 3-(N-methyl-N-n-amyl-)amino-6- methyl-7-phenylaminofluoran, 3-(N-ethyl-N-n-amyl)amino-6- methyl-7-phenylaminofluoran, 3-(N-ethyl-N-iso-amyl)amino6-methyl-7-phenylaminofluoran, 3-(N-methyl-N-n- ' hexyl)amino-6-methyl-7-phenylaminofluoran, 3-(N-ethyl-N-n- o hexyl)amino-6-methyl-7-phenylaminofluoran, and 3-(N-ethyl -N-β-ethylhexyl)amino-6-methyl-7-phenyl-aminofluoran. These basic dyes may be used in combination with one another if necessary.

The color developer includes inorganic or organic acid substances which produce a color upon contact with any of the above mentioned basic dyes. Their examples are: 4-tert-butylphenol, α-naphthol, β-naphthol, 4acetylphenol, 4-phenylphenol, hydroquinone, 4,4'-isopropylidenediphenol (bisphenol-A), 2,2'-methylenebis-(4chlorophenol), 4,4'-cyclohexylidenediphenol, 2,2'- bisphenol-4-methylpentane, 1,3-di-[2-(4-hydroxyphenyl)-2- propyl]-benzene, 4,4'-dihydroxy-diphenylsulfide, bis-(3- allyl-4-hydroxyphenyl)-sulfone, 4-hydroxyphenyl-4'-isopropyloxyphenylsulfone, hydroquinonemonobenzylether, 4hydroxybenzophenone, 2,4-di-hydroxybenzophenone, 2,4,4'trihydroxybenzophenone, 2,2',4,4'-tetrahydroxybenzophenone, dimethyl 4-hydroxy-phthalate, methyl 4hydroxybenzoate, ethyl 4-hydroxy-benzoate, propyl 4hydroxybenzoate, sec-butyl 4-hydroxy-benzoate, pentyl 4hydroxybenzoate, phenyl 4-hydroxy-benzoate, benzyl 4hydroxybenzoate, tolyl 4-hydroxy-benzoate, chlorophenyl 4- 0 hydroxybenzoate, phenylpropyl 4-hydroxybenzoate, phenetyl 4-hydroxybenzoate, p-chloro-benzyl 4-hydroxybenzoate, pmethoxybenzyl 4-hydroxy-benzoate; phenolic compounds such as novolak-type phenolic resin, phenol polymer, and phenolic compounds; benzoic acid, p-tert-butyl benzoic acid, trichlorobenzoic acid, terephthalic acid, 3-sec- butyl-4-hydroxybenzoic acid, 3-cyclohexyl-4-hydroxybenzoic acid, 3,5-dimethyl-4-hydroxybenzoic acid, salicylic acid, 3-isopropylsalicylic acid, 3-tert-butyl-salicylic acid, 3benzylsalicylic acid, 3-(α-methylbenzyl)salicylic acid, 3-chloro-5-(α-methylbenzyl)-salicylic acid, 3,5-di-tertbutylsalicylic acid, 3-phenyl-5-(α,α-dimethylbenzyl)salicylic acid, 3,5-di-α-methylbenzylsalicylic acid, and other aromatic carboxylic acids; salts of said phenolic compounds or aromatic carboxylic acids with a polyvalent metal such as zinc, magnesium, aluminum, calcium, titanium, manganese, tin, and nickel; and organic acid substances such as antipyrine complex of zinc thiocyanate. These color developers may be used in combination with one another.

A pronounced effect is produced when the color developer is 4,4'-iso-propylidenediphenol, 4-hydroxyphenyl-4'-iso-propyloxyphenylsulfone, or antipyrine complex of zinc thiocyanate which has a high melt viscosity when heat-melted.

The basic dye and color developer are used in a proper ratio which is not specifically limited but is determined according to their types. Usually, 1 part by weight of the basic dye is used for 1 to 20 parts by weight, preferably 2 to 10 parts by weight of the color developer.

The coating dispersion containing the above-mentioned basic dye and color developer is prepared by dispersing them into water individually or altogether using a mixer or grinder such as ball mill, attritor, and sand mill, and adding a slurry of the foregoing prismatic calcium carbonate thereto.

The coating dispersion usually contains a binder in an amount of 2 to 40 wt%, preferably 5 to 25 wt%, of the total amount of solids. Examples of the binder include starch, hydroxyethyl cellulose, methyl cellulose, carboxymethyl cellulose, gelatin, casein, gum arabic, polyvinyl alcohol, acetoacetyl-modified polyvinyl alcohol, diisobutylene-maleic anhydride copolymer salt, styrenemaleic anhydride copolymer salt, ethylene-acrylic acid copolmyer salt, styrene-acrylic acid copolymer salt, styrene-butadiene copolymer emulsion, urea resin, melamine resin, and amide resin.

The coating dispersion may further contain a variety of auxiliaries such as dispersing agent (e.g., sodium dioctylsulfosuccinate, sodium dodecylbenze-nesulfonate, lauryl alcohol sulfate ester sodium salt, and metal salt of fatty acid), UV light absorber (e.g., benzophenone), antifoaming, agent, fluorescent dye, and coloring dye.

The coating dispersion may further contain wax (e.g., zinc stearate, calcium stearate, polyethylene wax, carnauba wax, paraffin wax, and ester wax), fatty acid amide (e.g., stearic acid amide, stearic acid methylene bisamide, oleic acid amide, palmitic acid amide, and coconut fatty acid amide), hindered phenol (e.g., 2,2'-methylenebis(4-methyl-6-tert-butylphenol) and 1,1,3tris(2-methyl-4-hydroxy-5-tert-butylphenyl)butane), UV light absorber (e.g., 2-(2'-hydroxy-5'-methylphenyl)benzotriazole and 2-hydroxy-4-benzyloxybenzophenone), diaryloxyalkane(e.g., 1,2-di(e-methylphenoxy)ethane, 1,2diphenoxyethane, 1-phenoxy-2-(4-methylphenoxy)ethane), ester (e.g., dimethyl terephthalate, dibutyl terephthalate, dibenzyl terephthalate, p-benzyl-biphenyl, 1,4-dimethoxynaphthalene, 1,4-diethoxynaphthalene, and phenyl 1-hydroxynaphthoate), and other than these, known heat-fusible substance.

The coating dispersion may further contain an inorganic pigment such as kaolin, clay, talc, calcium carbonate (excluding prismatic one), calcined clay, titanium oxide, diatomaceous earth, anhydrous silica fine powder, and activated clay in amounts harmless to the effect of the prismatic calcium carbonate.

The coating dispersion may further contain an ordinary electrically conductive substance in amounts harmless to the desired effect of the present invention.

The recording layer in the heat-sensitive recording material of the present invention is formed by applying the coating dispersion followed by drying. The method of application is not specifically limited. For example, air knife coating or blade coating may be used. The amount of coating is not specifically limited; but it is usually 2 to 12 g/m$^2$, preferably 3 to 10 g/m$^2$ on the basis of dry weight.

As the substrate, there can be optionally used paper, plastic film, synthetic paper or synthetic fiber paper.

The heat-sensitive recording material of the present invention may be provided, if necessary, with additional layers which are known in the industry. For example, an overcoat layer (protective layer) may be formed on the recording layer for the purpose of protection; a protective layer may be formed on the backside of the substrate; an intermediate layer (undercoat) may be interposed between the substrate and the recording layer; and an adhesive layer may be formed on the back side of the recording material so that the recording material can be fabricated into self-adhesive stickers.

Incidentally, the protective layer is usually composed of a pigment (e.g., kaolin and talc), binder (e.g., starch and modified polyvinyl alcohol), an optional lubricant (e.g., zinc stearate), and an optional UV light absorber. The intermediate layer is usually composed of a pigment (e.g., calcined clay and anhydrous silica fine powder), a binder (e.g., styrene-butadiene copolymer emulsion, polyvinyl alcohol, and starch), an optional sensitizer, and an optional color developer. It is desirable that these layers should also contain the specific prismatic calcium carbonate.

DESCRIPTION OF THE PREFERRED EMBODIMENTS

The invention will be described in more detail with reference to the following examples, which are not intended to restrict the scope of the invention. In examples, "parts" and "%" mean "parts by weight" and "wt%", respectively, unless otherwise defined.

EXAMPLE 1

(1) Preparation of dispersion A

The following components were ground using a sand mill until the average particle size reached 3 μm.

3-(N-ethyl-N-iso-amyl)amino-6methyl-7-phenylamino-fluoran ..... 10 parts
1,2-di(3-methylphenoxy)ethane . . . 20 parts
methyl cellulose (5% aqueous solution) . . . 20 parts
water . . . 40 parts (2) Preparation of dispersion B The following components were ground using a sand mill until the average particle size reached 3 μm.

antipyrine complex of zinc thiocyanate . . . 30 parts
methyl cellulose (5% aqueous solution) . . . 40 parts
water . . . 20 parts (3) Preparation of dispersion C The following components were ground using a sand mill until the average particle size reached 3 μm.

1,1,3-tris(5-cyclohexyl-4hydroxy-o-tolyl)butane . . . 30 parts
methyl cellulose
(5% aqueous solution) . . . 40 parts
water . . . 20 parts (4) Formation of recording layer A coating dispersion was prepared by mixing 90 parts of dispersion A, 90 parts of dispersion B, 9 parts of dispersion C, 150 parts of 20% aqueous solution of oxidized starch, 30 parts of water, and 50 parts of a slurry (60% solids) of calcite prismatic calcium carbonate (having an average particle length and breadth of 1.0 μm and 0.15 μm, respectively, and a specific surface area of 38000 $cm^2$/ g). The coating dispersion was applied to base paper (50 $g/m^2$) in such an amount that the coating weight after drying was 6 $g/m^2$, and air-dried. The coated paper was finally subjected to supercalendering to give the desired heat-sensitive recording paper.

EXAMPLE 2 AND 3

Heat-sensitive recording paper was produced in the same manner as in Example 1 except that the slurry of calcite prismatic calcium carbonate was replaced by a slurry (60% solids) of aragonite prismatic calcium carbonate (having an average particle length and breadth of 2.3 μm and 0.3 μm, respectively, and a specific surface area of 32000 $cm^2/g$) (in Example 2) and by a slurry (60% solids) of aragonite prismatic calcium carbonate (having an average particle length and breadth of 5.0 pm and 0.4 μm, respectively, and a specific surface area of 25000 $cm^2/g$) (in Example 3).

EXAMPLE 4

(1) Formation of intermediate layer

A coating dispersion was prepared by mixing 20 parts of water, 85 parts of 12% aqueous solution of polyvinyl alcohol, and 150 parts of a slurry (60% solids) of aragonite prismatic calcium carbonate (having an average particle length and breadth of 2.3 μm and 0.3 μm, respectively, and a specific surface area of 32000 $cm^2/g$). The coating dispersion was applied to base paper (50 $g/m^2$) in such an amount that the coating weight after drying was 5 $g/m^2$, and air-dried. The coated paper was finally subjected to supercalendering to give base paper having an intermediate layer.

(2) Formation of recording paper

A coating dispersion was prepared by mixing 90 parts of the foregoing dispersion A, 90 parts of the foregoing dispersion B, 9 parts of the foregoing dispersion C, 100 parts of 20% aqueous solution of oxidized starch, 75 parts of water, and 10 parts of a slurry (60% solids) of calcite prismatic calcium carbonate (having an average particle length and breadth of 1.0 μm and 0.15 μm, respectively, and a specific surface area of 38000 $cm^2/g$). The coating dispersion was applied onto the intermediate layer in such an amount that the coating weight after drying was 4.5 $g/m^2$, and air-dried. The coated paper was finally subjected to supercalendering to give the desired heat-sensitive recording paper.

COMPARATIVE EXAMPLES 1 TO 5

Heat-sensitive recording paper was produced in the same manner as in Example 1 except that 50 parts of the slurry(60 % solids) of calcite prismatic calcium carbonate was replaced by 30 parts of aragonite needle-shaped calcium carbonate intertwined particles (having an average particle diameter of 3.5 pm and an oil absorption of 95 ml/100 g, "Calrite SA" made by Shiraishi Calcium Co., Ltd.) (in Comparative Example 1); by 50 parts of a slurry (60% solids) of aragonite prismatic calcium carbonate (having an average particle length and breadth of 5.0 μm and 0.07 μm, respectively, and a specific surface area of 48000 $cm^2/g$) (in Comparative Example 2); by 50 parts of a slurry (60% solids) of aragonite prismatic calcium carbonate (having an average particle length and breadth of 6.5 pm and 0.8 pm, respectively, and a specific surface area of 20000 $cm^2/g$) (in Comparative Example 3); by 30 parts of calcite calcium carbonate spindle-shaped particles (having an average particle diameter of 3.2 μm and an oil absorption of 47 ml/100 g, "PC" made by Shiraishi Calcium Co., Ltd.) (in Comparative Example 4); and by 30 parts of silicon oxide pigment (having an average particle diameter of 1.8 μm, a specific surface area of 80 $m^2/g$, and an oil absorption of 180 ml/100 g, "Mizukasil P-527" made by Mizusawa Chemical Co., Ltd.) (in Comparative Example 5).

COMPARATIVE EXAMPLE 6

Heat-sensitive recording paper was produced in the same manner as in Example 4 except that 150 parts of the slurry of aragonite prismatic calcium carbonate was replaced by 60 parts of water and 90 parts of aragonite needle-shaped calcium carbonate intertwined particles (having an average particle diameter of 3.5 μm and an oil absorption of 95 ml/100 g, "Calrite SA" made by Shiraishi Calcium Co., Ltd.) in the formation of the intermediate layer, and 10 parts of the slurry of calcite prismatic calcium carbonate was replaced by 6 parts of aragonite needle-shaped calcium carbonate intertwined particles (having an average particle diameter of 3.5 μm and an oil absorption of 95 ml/100 g, "Calrite SA" made by Shiraishi Calcium Co., Ltd.) in the formation of the recording layer.

EVALUATION

The heat-sensitive recording papers prepared in Examples 1 to 4 and Comparative Examples 1 to 6 were evaluated for the following items. The results obtained were as shown in Table 1.

Recording density

The heat-sensitive recording paper was passed through a high-speed facsimile ("HIFAX-400" made by Hitachi Ltd.) to record an image of the facsimile test chart No. 2 specified by the Society of Image Electronics. The density of the recorded image was measured using a Macbeth densitometer (RD914, made by Macbeth Co., Ltd.)

Generation of foreign matters

The heat-sensitive recording paper was passed through a high-speed facsimile ("HIFAX-210" made by Hitachi Ltd.) to conduct once recording of a known test chart of A-4 size, 65 % of which area being recorded with images (provided by the Society of Image Electronics). Then, the amount of foreign matters generated from the recording paper, which were deposited in the belt-like form along the recording head, was observed by measuring the width of the resultant belt-like deposit in accordance with the conventional method.

The criteria for judging each of the resultant heat-sensitive recording papers of whether usable or not in the viewpoint of the foreign matters had been experimentally set up for the width of the belt-like formed deposit as resulted in the following way in advance:

(1) the case where the foregoing width is less than 0.8 mm: no foreign matter obstruction for the recording;
(2) the case where the foregoing width is in the range of from 0.8 mm to 1.5 mm: slight foreign matter obstruction for the recording but no practical problem; and
(3) the case where the foregoing width is more than 1.5 mm: practically not acceptable; significant deposition of foreign matters will be caused and problems such as appearance of linear-like recorded part in the paper carrying direction will occur.

Retention of whiteness

The heat-sensitive recording paper was examined for change with time in whiteness using a Hunter whiteness meter.

It is noted from Table 1 that the heat-sensitive recording paper according to the present invention contaminates the recording head only slightly and changes very little in the whiteness of the recording layer even with the lapse of time.

TABLE 1

| | record density | amount of adhered foreign matters | whiteness (%) immediately after the production | whiteness (%) after storage for 2 weeks | reduction ratio of the whiteness (%) |
|---|---|---|---|---|---|
| Example 1 | 1.18 | 0.6 mm | 82.5 | 79.5 | 3.6 |
| Example 2 | 1.16 | 0.4 mm | 82.4 | 79.1 | 4.0 |
| Example 3 | 1.17 | 0.7 mm | 82.2 | 79.1 | 3.8 |
| Example 4 | 1.25 | 0.3 mm | 83.1 | 80.6 | 3.0 |
| Comparative example 1 | 1.19 | 2.0 mm | 82.2 | 78.8 | 4.1 |
| Comparative example 2 | 1.16 | 3.7 mm | 82.3 | 79.2 | 3.8 |
| Comparative example 3 | 1.03 | 1.8 mm | 82.4 | 79.2 | 3.9 |
| Comparative example 4 | 1.07 | 4.7 mm | 82.1 | 78.7 | 4.1 |
| Comparative example 5 | 1.14 | 0.9 mm | 82.5 | 78.0 | 5.5 |
| Comparative example 6 | 1.24 | 3.8 mm | 83.0 | 80.0 | 3.6 |

What is claimed is:

1. An improved heat-sensitive recording material of the type having a substrate and a heat-sensitive recording layer formed thereon which contains a colorless or light-colored basic dye and a color developer to color said basic dye upon contact by heating, characterized in that the heat-sensitive recording layer is formed by applying a coating dispersion containing prismatic calcium carbonate comprising single particles each having such a particle size that the average length is 1 to 6 μm and the average breadth is 0.1 to 0.6 μm.

2. A heat-sensitive recording material according to claim 1, wherein the prismatic calcium carbonate comprises from 5 to 60 wt% of the total amount of solids in the heat-sensitive recording layer.

3. A heat-sensitive recording material according to claim 1, wherein the prismatic calcium carbonate is calcite.

4. A heat-sensitive recording material according to claim 1, which further comprises an undercoat layer between the substrate and the heat-sensitive recording layer and/or a protective layer on the heat-sensitive recording layer, said undercoat layer and/or protective layer being formed by applying a coating dispersion containing prismatic calcium carbonate comprising single particles each having such a particle size that the average length is 1 to 6 μm and the average breadth is 0.1 to 0.6 pm.

5. A heat-sensitive recording material according to claim 1, wherein the color developer is at least one of 4,4'-iso-propylidenediphenol, 4-hydroxy- phenyl-4'-iso-propyloxyphenylsulfone, or an antipyrine complex of zinc thiocyanate.

* * * * *